US005201806A

United States Patent [19]

Wood

[11] Patent Number: 5,201,806

[45] Date of Patent: Apr. 13, 1993

[54] TILTED FUEL INJECTOR HAVING A THIN DISC ORIFICE MEMBER

[75] Inventor: Ross W. Wood, Newport News, Va.

[73] Assignee: Siemens Automotive L.P., Auburn Hills, Mich.

[21] Appl. No.: 716,168

[22] Filed: Jun. 17, 1991

[51] Int. Cl.[5] ..... F02M 55/02; F02M 61/00

[52] U.S. Cl. ..... 123/470; 123/472; 239/533.12

[58] Field of Search ..... 123/470, 472; 239/585.1, 585.3, 585.5, 533.12, 533.14

[56] References Cited

U.S. PATENT DOCUMENTS

| | | | |
|---|---|---|---|
| 4,515,129 | 5/1985 | Stettner | 123/472 |
| 4,628,576 | 12/1986 | Giachino | 239/533.12 |
| 4,650,122 | 3/1987 | Kienzle | 239/533.12 |
| 4,830,286 | 5/1989 | Asslaender | 239/585.3 |
| 4,890,794 | 1/1990 | Imafuku | 239/533.12 |
| 4,923,169 | 5/1990 | Grieb | 239/585.1 |
| 4,945,877 | 8/1990 | Ziegler | 123/472 |
| 4,979,479 | 12/1990 | Furukawa | 123/472 |
| 5,054,456 | 10/1991 | Rush | 123/470 |
| 5,109,823 | 5/1992 | Yokoyama | 239/533.12 |
| 5,129,381 | 7/1992 | Nakajima | 239/533.12 |

FOREIGN PATENT DOCUMENTS

| | | | |
|---|---|---|---|
| 667463 | 3/1952 | United Kingdom | 239/533.12 |

*Primary Examiner*—Carl S. Miller

*Attorney, Agent, or Firm*—George L. Boller; Russel C. Wells

[57] ABSTRACT

A fuel injector has a thin disc orifice member through which fuel exits the injector for entrainment with combustion air. The thin disc orifice member has a centrally disposed dimple that contains the orifice pattern. The orifice pattern is asymmetrical about the axis of the dimple thereby enabling the injector to be tilted to a desired orientation for directing the stream from each orifice of the pattern toward a desired target zone. The ability to tilt a fuel injector in this manner enables a fuel injector to be disposed in the most favorable orientation with respect to the engine, for example reducing the protrusion height of the fuel injector above the engine.

10 Claims, 3 Drawing Sheets

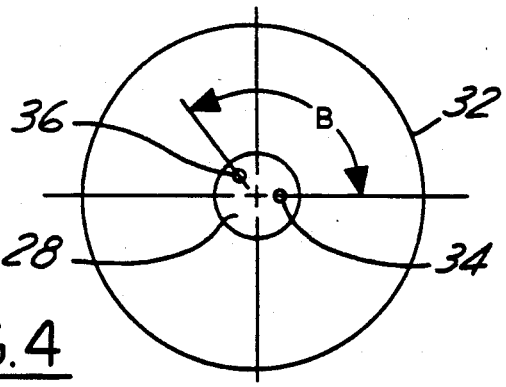

FIG. 4

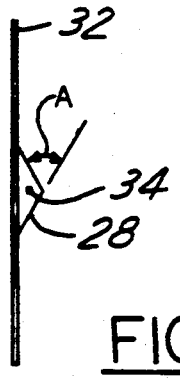

FIG. 5

WHERE: A = INCLUDED ORIFICE ANGLE (0-30°)
B = ANGLE BETWEEN HOLES (0-180°)

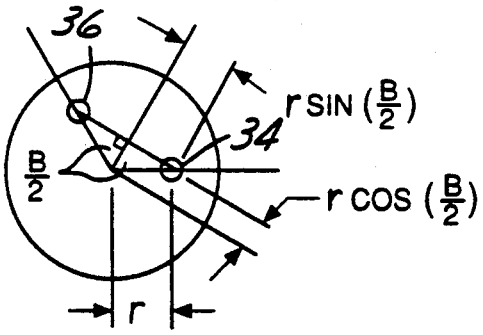

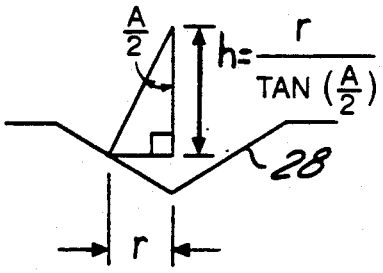

$$\text{SPLIT ANGLE} = \alpha = 2 = \text{TAN}^{-1}\left[\text{TAN}\left(\frac{A}{2}\right) \times \text{SIN}\left(\frac{B}{2}\right)\right]$$

$$\text{TILT ANGLE} = \beta = \text{TAN}^{-1}\left[\text{TAN}\left(\frac{A}{2}\right) \times \text{COS}\left(\frac{B}{2}\right)\right]$$

GIVEN A, B
FIND α, β

$$\text{"DIMPLE" ANGLE} = A = 2 \times \text{TAN}^{-1}\left[\text{TAN}\left(\frac{\alpha}{2}\right) \Big/ \text{SIN}\left(\frac{\beta}{2}\right)\right], \text{WHERE}$$

$$\text{HOLE ANGLE} = B = 2 \times \text{TAN}^{-1}\left[\text{TAN}\left(\frac{\alpha}{2}\right) \Big/ \text{TAN}\,\beta\right]$$

GIVEN α, β
FIND A, B

FIG. 6

TILTED FUEL INJECTOR HAVING A THIN DISC ORIFICE MEMBER

FIELD OF THE INVENTION

This invention relates to fuel injected internal combustion engines wherein an electrically operated fuel injector is poised to inject liquid fuel into the engine for entrainment with combustion air to form a combustible mixture and the fuel injector is of the type which comprises a thin disc orifice member via which the injected fuel exits the fuel injector.

BACKGROUND AND SUMMARY OF THE INVENTION

The state of the art is represented by commonly assigned U.S. Pat. Nos. 4,854,024; 4,923,169; and 4,934,653. FIGS. 8 and 9 of U.S. Pat. No. 4,923,169 illustrate a thin disc orifice member containing a cone-shaped dimple. Two orifices are contained in the dimple and are symmetrically arranged about the dimple's axis. Each orifice emits a corresponding stream of liquid fuel. That fuel injector can be used in association with an engine's combustion chamber cylinder which has two parallel intake valves to the cylinder. The fuel injector's axis, and hence that of the dimple, is aimed at a line extending between target zones on the respective intake valves, and the fuel injector is circumferentially oriented in its mounting hole such that each stream of fuel passing through the orifices of the thin disc orifice member is aimed toward a corresponding target zone on the corresponding intake valve.

The present invention relates to a new and unique orifice arrangement in a thin disc orifice member which provides substantially improved versatility in mounting of the fuel injector on the engine. Specifically, the invention makes it possible to mount the fuel injector on the engine in orientations which would be impossible with a fuel injector embodying the thin disc orifice member of FIGS. 8 and 9 of U.S. Pat. No. 4,923,169 while still directing individual fuel streams toward the desired individual target zones on the individual intake valves. Because of the invention, the packaging of the fuel injectors on an engine is not necessarily restricted by a requirement that the fuel injector axis lie in a plane that perpendicularly bisects a line extending between the target zones, nor by a requirement that the fuel injector axis point toward a line extending between the target zones. Accordingly, the invention can serve to significantly facilitate fuel injector packaging and installation on certain engines. For example, the invention can provide a reduced-height packaging envelope for the fuel injectors, and in an automotive vehicle this can be important from the standpoint of engine compartment design and vehicle styling. The principles of the invention are adapted not only to thin disc orifice members having multiple orifices, but to those having but a single orifice. The ensuing description will present embodiments of the present invention which contain a thin disc orifice member having a single orifice in its dimple and a thin disc orifice member having two single orifices in its dimple.

Further features, advantages and benefits of the invention will be seen in the ensuing description and claims which should be considered in conjunction with the accompanying drawings illustrating a presently preferred embodiment of the invention according to the best mode contemplated at the present time in carrying out the invention.

BRIEF DESCRIPTION OF THE DRAWINGS

FIG. 4 is a view in the same direction as the view of FIG. 2 showing another embodiment of thin disc orifice member.

FIG. 5 is a side view of FIG. 4.

FIG. 6 is a composite presentation of certain geometric relationships involved in the design of a thin disc orifice member like the one of FIGS. 4 and 5.

DESCRIPTION OF THE PREFERRED EMBODIMENT

Figure 1:
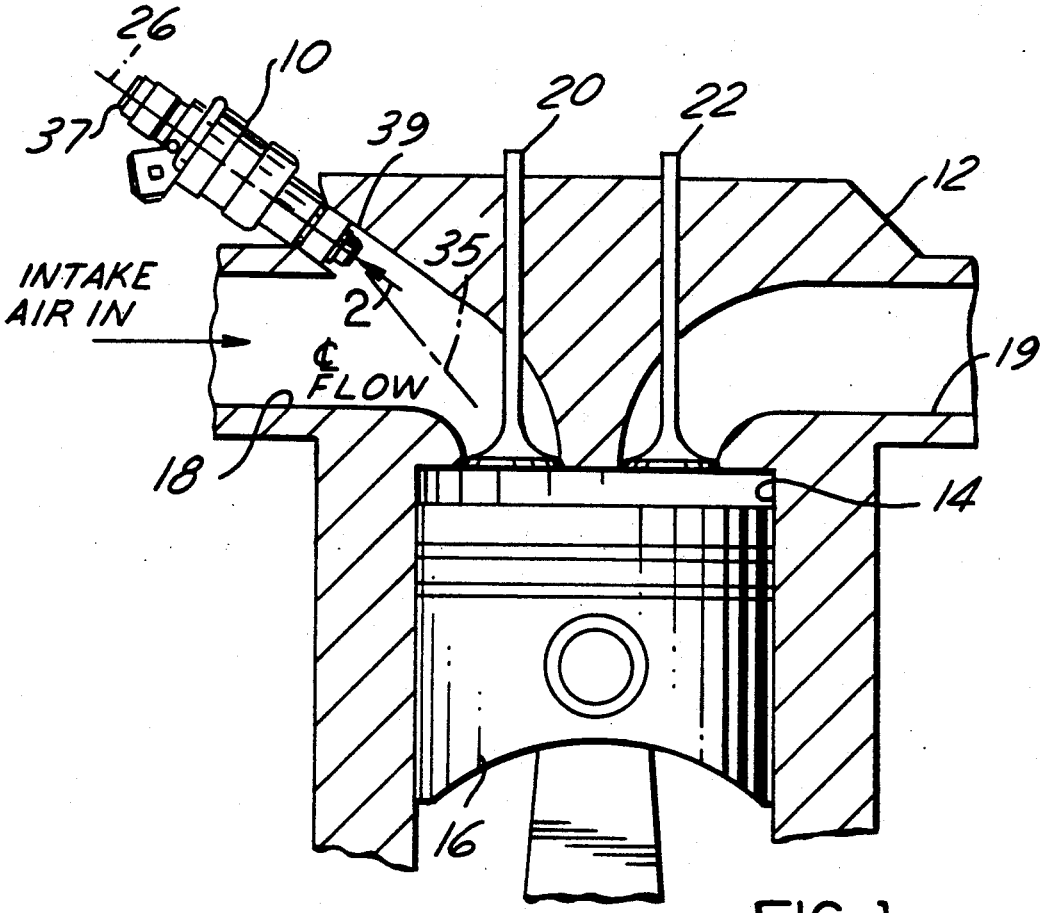
FIG. 1 is a fragmentary view, partly in cross section, through a portion of an internal combustion engine having a fuel injector in accordance with principles of the invention.
Figure 2:
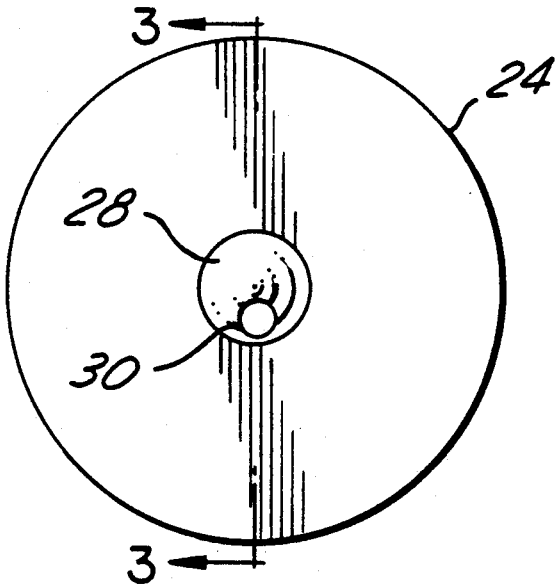
FIG. 2 is an enlarged view looking in the direction of arrow 2 in FIG. 1 showing the injector's thin disc orifice member by itself.
Figure 3:
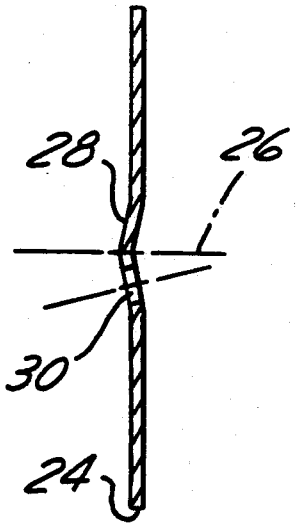
FIG. 3 is a sectional view in the direction of arrows 3—3 in FIG. 2.
Figure 3A:
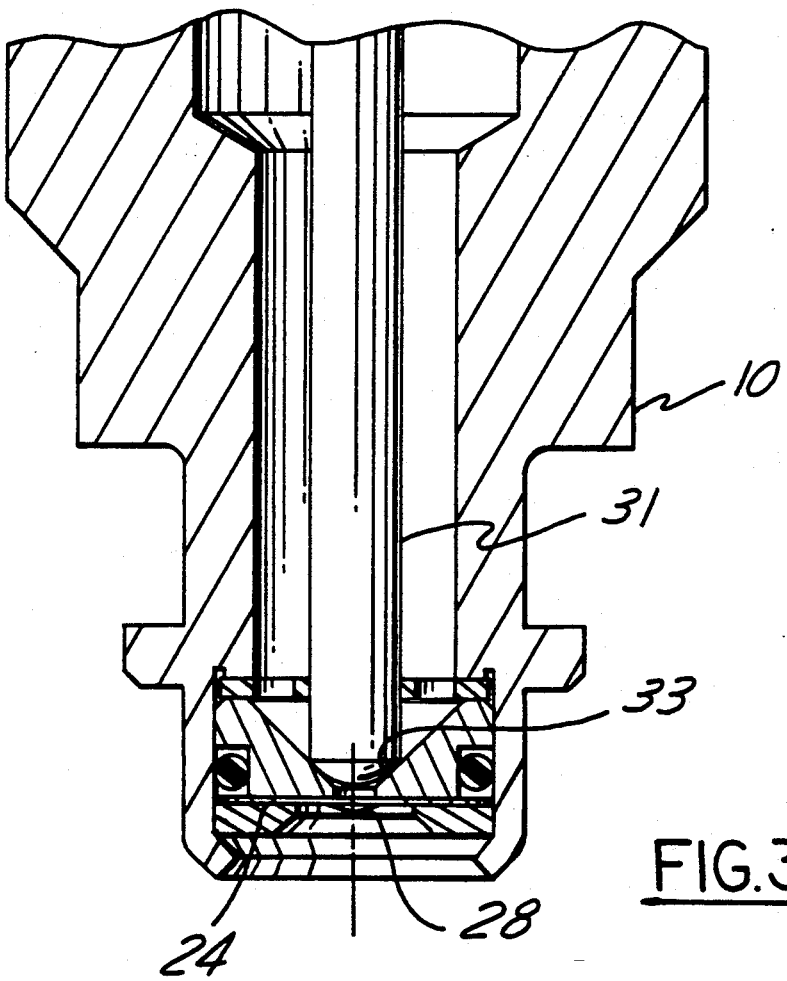
FIG. 3A shows the thin disc orifice member in assembly on the fuel injector.

A first embodiment of the invention is portrayed in FIGS. 2, 3, and 3A and is seen to comprise an electrically operated fuel injector 10 mounted on an internal combustion engine 12 in association with a combustion cylinder 14 that contains a reciprocating piston 16 that drives the engine's crankshaft (not appearing in FIG. 1). An air intake passage 18 leads to cylinder 14, and an exhaust passage 19 leads from cylinder 14. Flow through intake passage 18 into cylinder 14 is controlled by an intake valve 20, and flow from cylinder 14 through exhaust passage 19 is controlled by an exhaust valve 22. The two valves 20, 22 are operated in suitably timed relation in a manner well-known in the art. Fuel injector 10 is disposed in association with intake passage 18 for injecting liquid fuel into the intake air for entrainment therewith and the resulting formation of a combustible mixture in the combustion chamber space of the cylinder which is ultimately ignited at the appropriate time in the engine cycle to produce hot gases that power the engine and are subsequently exhausted through the exhaust passage in well-known manner.

The inventive features relate to certain details of the construction of fuel injector 10 and the relationship thereof to certain portions of the engine. Fuel injector 10 is by way of example like the fuel injector shown and described in commonly assigned U.S. Pat. No. 4,610,080, and includes a thin disc orifice member 24 at its nozzle end. Member 24 is similar to that illustrated and described in U.S. Pat. No. 4,923,169, also commonly assigned, and it can be manufactured in the manner set forth in that patent. FIG. 3A illustrates detail of the nozzle end of the fuel injector, including member 24. The reference numeral 26 designates the main longitudinal axis of the fuel injector and the member 24 is coaxial with axis 26.

Member 24 comprises a centrally disposed cone-shaped dimple 28 that protrudes away from the injector. The cone axis of the dimple is coaxial with axis 26. Member 24 comprises a single orifice 30 through which a stream of liquid fuel is emitted from the fuel injector when the fuel injector is electrically energized to lift its needle 31 from its seat 33. (FIG. 3 shows the de-energized state.) Orifice 30 is circular and is located axially substantially half-way along the dimple. Thus the orifice pattern of member 24 is asymmetric, unlike that of U.S. Pat. No. 4,923,169, which is symmetric. The asymmetric pattern, which comprises the orifice being disposed in one diametrical half of the dimple about axis 26 while the opposite half is imperforate, enables the injector to be tilted more toward parallelism with air intake 18 than would be the case with a symmetric orifice pattern. If the objective of the injector installation on the engine is to direct a stream of liquid fuel toward a certain location, such as at the junction of the stem and head of intake valve 20, the invention makes it unnecessary for axis 26 to be aimed directly at the target location. Thus, with the invention, as shown by FIG. 1, the axis of the injector can be tipped closer to passage 18 so as to be non-coaxial with a line 35 extending between the nozzle tip and the target zone. Such tipping of the injector means that the feed end 37 which lies opposite the nozzle end does not protrude vertically as high as it otherwise would, and therefore the invention can provide the advantage of reducing the packaging envelope of the fuel injector on the engine. Although not explicitly shown in the drawings, it is preferred that there be a suitable circumferential locator means for properly circumferentially locating the injector with respect to the axis of its mounting hole 39 so that the fuel stream emitted from the single orifice is aimed at the desired target zone.

FIGS. 4–6 relate to a second embodiment of the invention which is adapted for use with a cylinder which has two spaced apart intake valves. The second embodiment comprises a fuel injector that can be exactly like the fuel injector of FIG. 1, but with a different thin disc orifice member 32. Member 32 is like member 24 except that member contains two individual discrete orifices 34, 36. Each orifice 34, 36 is a circular hole through the cone-shaped dimple 28 axially substantially half-way along the dimple, but the two orifices are arranged in an asymmetrical pattern, which comprises the orifices being disposed in one diametrical half of the dimple about its axis while the opposite half is imperforate. In use it is intended that one of the orifices emit of liquid fuel directly at a particular target zone, such as a particular location on one of the two intake valves for the cylinder, while the other orifice emits a stream of liquid fuel directly at another particular target zone, such as a particular location on the other intake valve. The asymmetrical pattern of the two orifices enables this intention to be realized with a tilting of the injector in an analogous manner to the single orifice embodiment of FIG. 1 so that the protrusion height of the fuel injector from the engine can be reduced from what would otherwise be the case. This enables a fuel injector to be mounted on an engine where otherwise such mounting might be impossible due to the geometry of the engine and/or the immediate environment surrounding the fuel injector.

With both embodiments of the invention, it is also possible to tilt the fuel injector laterally so that the invention enables many possible orientations to be assumed by the fuel injector in relation to the engine while still directing fuel to the desired target zone or zones. Such orientations can therefore involve tilting about a vertical axis, about a horizontal axis, or a combination of both.

FIG. 6 presents the geometrical relationships involved in locating the two orifices 34, 36 in the dimple for desired target zones. The angles A and B are defined in FIGS. 4 and 5, A being referred to as the dimple angle, and B being referred to as the hole angle. The split angle $\alpha$ is the included angle between the streams emitted from orifices 34, 36 as measured at the injector nozzle tip. The tilt angle $\beta$ is the angle between the injector's axis and a line projected from the nozzle tip to the intake valves. With knowledge of and one can calculate $\alpha$ and $\beta$, and vice versa.

While a presently preferred embodiment of the invention has been illustrated and described, principles are applicable to other embodiments within the scope of the following claims.

I claim:

1. In an internal combustion engine having one or more target zones toward each of which an electrically operated fuel injector directs a corresponding stream of liquid fuel via orifice means in a thin disc orifice member via which fuel exits the fuel injector, said fuel injector having a longitudinal axis, said orifice means being disposed in a cone-shaped dimple that is centrally located in said thin disc orifice member and protrudes in a direction away from the fuel injector to terminate in a tip, said cone-shaped dimple having an axis that is co-axial with said axis of the fuel injector, the improvement which comprises the co-axis of said dimple and said fuel injector being non-parallel to a line projected from the tip of the dimple to such target zones, and said orifice means comprising a pattern that consists of one or more distinct orifices and that is located within one diametrical half of said dimple extending 180 degrees about the axis of said dimple, the opposite diametrical half of said dimple being imperforate.

2. The improvement set forth in claim 1 in which said pattern comprises a single orifice.

3. The improvement set forth in claim 2 in which said single orifice is disposed axially substantially half-way along said dimple in the direction away from the fuel injector.

4. The improvement set forth in claim 1 in which said pattern comprises two single orifices spaced apart in the direction about the axis of said dimple.

5. The improvement set forth in claim 4 in which said two single orifices are disposed axially substantially half-way along said dimple in the direction away from the fuel injector.

6. In an electrically operated fuel injector for injecting liquid fuel into combustion air in an internal combustion engine, said fuel injector having a longitudinal axis, said fuel injector comprising a thin disc orifice member comprising orifice means via which fuel exits the fuel injector, said orifice means being disposed in a cone-shaped dimple that is centrally located in said thin disc orifice member and protrudes in a direction away from the fuel injector to terminate in a tip, said cone-shaped dimple having an axis that is co-axial with said axis of the fuel injector, the improvement which comprises said orifice means comprising a pattern that consists of one or more distinct orifices and that is located within one diametrical half of said dimple extending 180 degrees about the axis of said cone-shaped dimple, the opposite diametrical half of said dimple being imperforate.

7. The improvement set forth in claim 6 in which said pattern comprises a single orifice.

8. The improvement set forth in claim 7 in which said single orifice is disposed axially substantially half-way along said dimple in the direction away from the fuel injector.

9. The improvement set forth in claim 6 in which said pattern comprises two single orifices spaced apart in the direction about the axis of said dimple.

10. The improvement set forth in claim 9 in which said two single orifices are disposed axially substantially half-way along said dimple in the direction away from the fuel injector.

* * * * *